US010257604B2

(12) United States Patent
Birath

(10) Patent No.: US 10,257,604 B2
(45) **Date of Patent: *Apr. 9, 2019**

(54) HEADSET WITH EAR SUPPORT

(71) Applicant: Zound Industries International AB, Stockholm (SE)

(72) Inventor: Martin Birath, Lidingö (SE)

(73) Assignee: Zound Industries International AB, Stockholm (SE)

( * ) Notice: Subject to any disclaimer, the term of this patent is extended or adjusted under 35 U.S.C. 154(b) by 22 days.

This patent is subject to a terminal disclaimer.

(21) Appl. No.: 15/153,616

(22) Filed: May 12, 2016

(65) Prior Publication Data

US 2016/0337739 A1 Nov. 17, 2016

(30) Foreign Application Priority Data

May 15, 2015 (SE) ..... 1550627

(51) Int. Cl.
*H04R 1/10* (2006.01)
*H04R 5/033* (2006.01)

(52) U.S. Cl.
CPC ..... *H04R 1/105* (2013.01); *H04R 1/1008* (2013.01); *H04R 1/1066* (2013.01); *H04R 5/0335* (2013.01); *H04R 2420/07* (2013.01)

(58) Field of Classification Search
CPC .... H04R 1/105; H04R 1/1008; H04R 1/1066; H04R 5/0335; H04R 1/10; H04R 2420/07
See application file for complete search history.

(56) References Cited

U.S. PATENT DOCUMENTS 5,210,792 A 5/1993 Kajihara
5,412,736 A 5/1995 Keliiliki
(Continued)

FOREIGN PATENT DOCUMENTS

EP 0994636 A2 1/2006
EP 2277321 1/2011
(Continued)

OTHER PUBLICATIONS

Plantronics, Backbeat Fit User Guide, 2014, Plantronics Inc. pp. 1-16.*
(Continued)

*Primary Examiner* — Fan S Tsang
*Assistant Examiner* — Angelica M McKinney
(74) *Attorney, Agent, or Firm* — Knobbe Martens Olson & Bear LLP

(57) ABSTRACT

A headset having first and second audio listening devices, each device having an inner side and an outer side and an ear support for holding the audio listening device in the ear of a user, wherein each ear support is attached to opposite ends of a resilient cord adapted to extend behind the head of a user. Each ear support comprises an elongated support portion extending along a first longitudinal axis and further adapted to rest on an upper part of a user's ear, and an elongated leg which is interconnected with the elongated support portion by a first bend such that the elongated leg forms an acute angle with the elongated support portion, whereby the ear support is attached to the outer side of the audio listening device such that the elongated leg is inclined in direction of the inner side of the audio listening device.

19 Claims, 3 Drawing Sheets

(56) References Cited

U.S. PATENT DOCUMENTS

| | | | | |
|---|---|---|---|---|
| 5,457,751 | A | 10/1995 | Such | |
| 5,757,944 | A | 5/1998 | Jensen et al. | |
| 5,761,298 | A | 6/1998 | Davis et al. | |
| 6,104,824 | A * | 8/2000 | Ito | H04R 5/0335 379/430 |
| 6,195,441 | B1 | 2/2001 | Ito | |
| 6,449,374 | B1 | 9/2002 | Skulley et al. | |
| 6,580,800 | B1 | 6/2003 | Yamasaki et al. | |
| 6,584,208 | B2 | 6/2003 | Cheng | |
| 6,810,987 | B1 | 11/2004 | DeKalb | |
| 8,208,672 | B2 * | 6/2012 | Nageno | H04R 5/0335 381/370 |
| 8,320,603 | B2 * | 11/2012 | Bass | H04R 1/10 381/330 |
| 8,761,431 | B1 * | 6/2014 | Jackson | H04R 5/0335 381/367 |
| 9,319,769 | B2 * | 4/2016 | Burgett | H04R 1/105 |
| 2003/0174853 | A1 | 9/2003 | Howes et al. | |
| 2007/0071269 | A1 * | 3/2007 | Milde | H04R 5/0335 381/378 |
| 2007/0248238 | A1 * | 10/2007 | Abreu | G02C 3/003 381/381 |
| 2008/0144854 | A1 | 6/2008 | Abreu | |
| 2008/0264429 | A1 | 10/2008 | Leong et al. | |
| 2011/0123059 | A1 | 5/2011 | Hu | |
| 2011/0255729 | A1 | 10/2011 | Tan et al. | |
| 2013/0114842 | A1 | 5/2013 | Jennings | |
| 2013/0195310 | A1 | 8/2013 | Lin | |
| 2014/0185821 | A1 | 7/2014 | Ushakov | |
| 2014/0270317 | A1 | 9/2014 | Burgett et al. | |
| 2016/0279435 | A1 * | 9/2016 | Hyde | A61N 2/002 |

FOREIGN PATENT DOCUMENTS

| | | | |
|---|---|---|---|
| EP | 2611210 | A1 | 7/2013 |
| GB | 2484069 | A | 4/2012 |
| KR | 20120017920 | A * | 2/2012 |
| KR | 10-1159795 | | 6/2012 |
| KR | 101159795 | | 6/2012 |
| KR | 101159795 | B1 * | 6/2012 |
| WO | WO03/075608 | A1 | 9/2003 |
| WO | WO2014/051416 | A1 | 4/2014 |

OTHER PUBLICATIONS

Ocakoglu et al., The Shape of the External Human Ear: A Geometric Morphometric Study, 2013, Turkitiye KliniKleri J Med Sci, pp. 184-190.*

Extended European Search report in EP Application No. 16169188.6 dated Oct. 12, 2016.

International Search Report in PCT Application No. PCT/SE2016/050423 dated Jun. 7, 2016.

Swedish Office Action issued in Patent Application No. 1550626-4, dated Nov. 12, 2015 (priority application).

Swedish Office Action issued in Patent Application No. 1550627-2, dated Nov. 12, 2015 (priority application).

Extended European Search report in EP Application No. 16169107.6 dated Oct. 11, 2016.

International Search Report in PCT Application No. PCT/SE2016/050421 dated Jun. 7, 2016.

* cited by examiner

HEADSET WITH EAR SUPPORT

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57. For example, this application claims the benefit of priority to Swedish Patent Application No. 1550627-2, filed on May 15, 2015, the disclosure of which is hereby incorporated by reference in its entirety for all purposes.

BACKGROUND

Field

The present disclosure relates to a headset comprising a pair of audio listening devices to be worn by a user e.g. when listening to audio content.

Description of the Related Art

A headset makes it possible for a wearer thereof to listen to audio content, such as music or radio broadcasts in environments or situations where it is unsuitable to play the audio content aloud, for example in public spaces where other people may be disturbed.

A simple form of a headset comprises one or two audio listening devices in the form of miniature loudspeakers or headphones which are attached to a support ribbon which is carried on the head of the user so that the loudspeakers are placed in close proximity to the ears of the user. The headset is typically connected to an audio source such as a cellular phone, a radio or an MP3-player.

Headsets may also be used in situations where the user is physically active. For example, a person performing sports may use a headset to listen to music while running or bicycling. Also, police personnel or firefighters may use headsets as a component in a communication system.

A requirement of a headset for physical activities is that the audio listening devices remain in place in the ears of the user even during long and/or vigorous physical activity. Certain attempts have been made in the art to increase the stability of headsets.

One example of a headset is shown in the published patent application KR101159795 in which each audio listening device of the headset is attached to a hook-shaped support designed to surround the ear of the user. The hook-shaped support is elastic and bears against the rear part of the user's ear to increase the stability of the position of the audio listening device in the ear of the user. The hook-shaped support further extends into a ribbon which passes behind the neck of the user.

A drawback with the headset of KR1011597795 is that the holding function of the hook-shaped support largely is based on the contact with the rear of the user's ear. The hook-shaped support may therefore hold the audio listening device sufficiently effective in place in the ear of the user. Moreover, the contact between the hook-shaped support and the rear part of the ear of the user may be uncomfortable, especially during longtime use.

Thus, it is an object of the present disclosure to achieve a headset which solves or at least mitigates at least one of the above drawbacks with the prior-art.

In particular, it is an object of the present application to achieve a head set which provides an improved holding of an audio listening device in the ear of a user. A further object of the present application is to provide an improved head set which may be held firmly on the head of a user. A further object of the present disclosure is to achieve a light-weight and comfortable headset. Yet a further object of the present disclosure is to achieve a robust headset of simple construction which may be produced at low cost.

SUMMARY

According to a first aspect of the present disclosure at least one of these objects is achieved by a headset comprising a first and a second audio listening device adapted to be placed in a respective ear of a user each audio listening device, having an inner side and an outer side, each audio listening device further comprising an ear support for holding the audio listening device in the ear of a user, wherein each ear support is attached to opposite ends of a resilient cord adapted to extend around the back of the head or the neck of a user, whereby each ear support comprises:

- an elongated support portion extending along a first longitudinal axis X1, X1' and further adapted to rest on an upper part of an ear of a user, and
- an elongated leg which is interconnected with the elongated support portion by means of a first bend B1, B1' such that the elongated leg forms an acute angle V1, V1' with the elongated support portion, wherein the ear support is attached to the outer side of audio listening device such that the elongated leg is inclined in direction of the inner side of the audio listening device.

Practical trials have shown that when the headset according to the disclosure is worn on the head of a user, the ear support is pressed firmly against the sides of the head of a user. This in turn causes the audio listening device to remain securely in place in the ear of the user, even during vigorous physical activity over long time.

The effective holding function of the headset is believed to depend on a combinatory effect between, on one hand, the inclination of the ear support towards the head of the user and, on the other hand, the acute angle between the elongated upper support portion and the leg of ear support. Thus, when the elongated support portion of the ear support is pulled backwards by the resilient cord attached thereto, the bend between the upper support portion and the elongated leg of the ear support is pressed into firm contact with the side of the head of the user.

According to one embodiment of the headset, an end portion of the ear support is interconnected with the elongated leg by a second bend B2, B2' such that the elongated leg forms the second acute angle V2, V2' with the end portion of the ear support 120. The second bend B2, B2' increases the radial distance between elongated leg and the outer side of the audio listening device. This in turn makes it possible to increase the inclination of the ear support and thus the strong holding force against the head of the user.

According to a further embodiment, an end portion of the elongated leg of the ear support is directly attached to the outer side of the audio listening device. This allows for a simple construction and the possibility to produce the headset at low cost. Moreover, since the headset comprises few protruding parts there is less risk that the headset gets entangled in the hair or clothes of the user.

According to an embodiment, at least the first bend B1, B1' of the ear support may be manufactured from a resilient material. By making a portion of the ear support in resilient material the ear support becomes more flexible, which has several advantages. On one hand, the resiliency makes the ear support to abut more strongly against the head of the user. On the other hand, the resiliency makes the ear support to flex more when it is pulled backwards by the resilient cord of headset. This in turn causes the first bend B1, B1' of the ear support to be pressed firmly against the sides of the head of the user. A further advantage is that the resilient bend B1, B1' allows the headset to be used on different head sizes.

According to an embodiment, at least a portion of the inner side of the audio listening device is adapted to be placed in contact with the concha of an ear of the user whereby the inner side of the audio listening device comprises an audio conducting means for conducting audio signals emitted from a transducer in the audio listening device into the ear canal of the user. Practical trials have shown that an excellent holding effect of the audio receiving devices in the ears the user is achieved when the audio listening device have this configuration.

According to an embodiment, the audio listening device may comprise a loop for abutment against the ear of the ear of a user. The loop fixes the audio listening device even more firmly in the ear of the user.

According to an alternative, the resilient cord is an electric spiral cable. Such a cable has the advantage that it is both resilient and conducts electrical signals. Thus, the cost of the head set is minimized

DETAILED DESCRIPTION

The headset according to the present disclosure will now be described more fully hereinafter. The headset according to the present disclosure may, however, be embodied in many different forms and should not be construed as limited to the embodiments set forth herein; rather, these embodiments are provided by way of example so that this disclosure will be thorough and complete, and will fully convey the scope of the present disclosure to those persons skilled in the art. Like reference numbers refer to like elements throughout the description.

Figure 1:
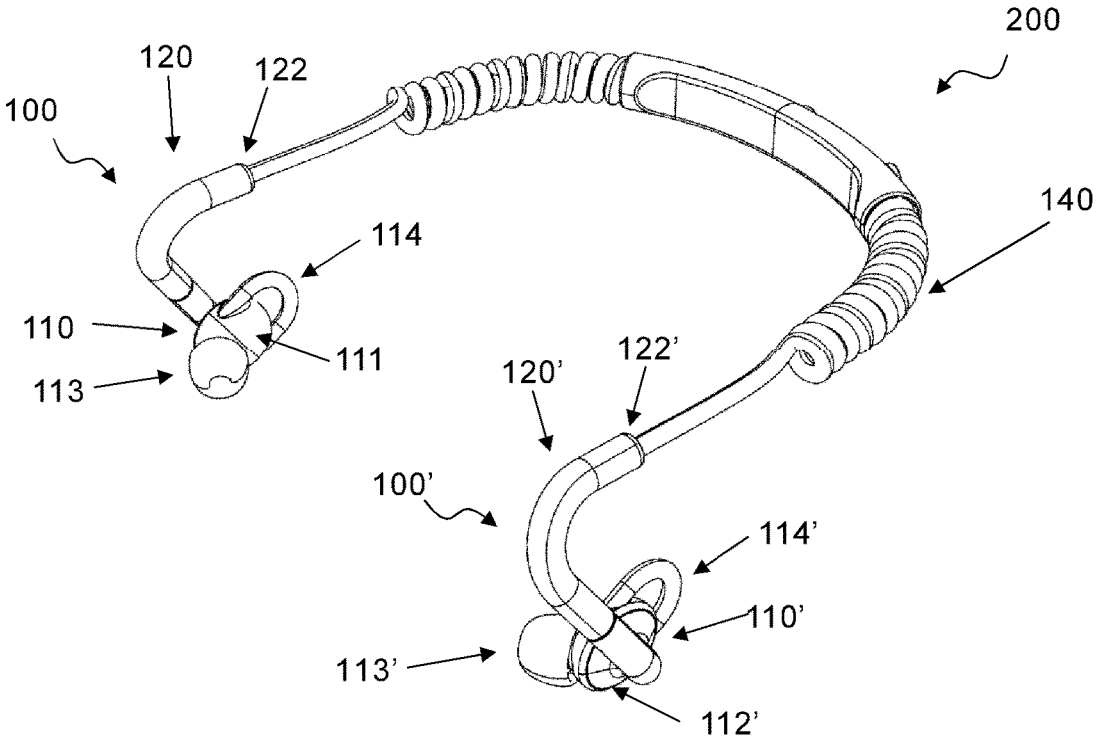
FIG. 1: A schematically perspective drawing of a headset according to a first embodiment of the present disclosure.

FIG. 1 shows schematically a headset 200 according to the disclosure. The headset comprises a first and a second audio listening device 110, 110' adapted to be placed in the ear of a user. Each audio listening device 110, 110' may comprise a transducer (not shown in the drawing). The transducer, which is enclosed within the audio listening device, may be any type of electric or electronic device capable of receiving electrical signals from a source, and convert the electric signals into acoustic signals, i.e. sound. For example, the transducer may comprise an electro-acoustic transducer, such as a loudspeaker.

The audio listening device 110, 110' has an inner side 111, 111' which is facing the ear when the audio listening device is placed in the ear of the user. The inner side 111' of audio listening device 100' is not visible in FIG. 1, however it is identical to the inner side 111 of audio listening device 100. More particularly, at least a portion of the inner side 111, 111' of the audio listening device 110, 110' is adapted to be supported against the concha of the ear of the user. Therefore, the inner side 111, 111', or inner surface 111, 111', is preferably flat. The inner side 111, 111' of the audio listening device 110, 110' further comprises an audio conducting means 113, 113' which is adapted to conduct acoustic signals emitted from the transducer 110, 110' of the audio listening device 110, 110' into the ear canal of the user of the headset. The audio conducting means 113, 113' may for example be an in-ear ear plug, as shown in FIG. 1. An in-ear plug is adapted to extend into the ear canal of the user of the headset and provides good generally sound transmission as well as being comfortable during use. Alternatively, the audio conducting means 113, 113' may be an ear bud (not show in the drawing). An ear bud is typically adapted to rest at the entrance of the ear canal of the user of the head set.

The audio listening device 110, 110' may further be provided with a loop 114, 114' which is arranged to abut the ear of the user. When the audio listening device is inserted in the ear of the user, the loop abuts the antihelix of the ear. The loop 114, 114', which preferably is flexible and manufactured from a resilient material, such as rubber, may provide extra stability of the audio listening device in the ear of a user. As shown in FIG. 1, the loop 114, 114 extends from the inner surface 111, 111' of the audio listening device 110, 110' in the direction of the resilient cord 140.

The audio listening device 110, 110' further has an outer side 112, 112', which is opposite to the inner side 111, 111' and thus directed radially away from the head of the user. The outer side 112 of audio listening device 100 is visible in FIG. 4.

The audio listening device 110, 110' further comprises an ear support 120, 120' for holding the audio listening device 110, 110' in place in the ear of a user. The audio listening device 110, 110' and the ear support 120, 120' forms an audio listening arrangement 100, 100'. The audio arrangement 100' may have features analogous to features of the audio listening arrangement 100 with the same numerals but with an apostrophe (') after the numeral.

The headset 200 further comprises a resilient cord 140 which is adapted to extend behind the head of a user. Each of the ear supports 120, 120' are attached to a respective end of the resilient cord 140 such that the resilient cord 140 extend from one ear support 120 to the other ear support 120'. The resilient cord 140 thereby extends from a respective end 122, 122' of an elongated support portion of each ear support 120, 120'.

Figure 2:
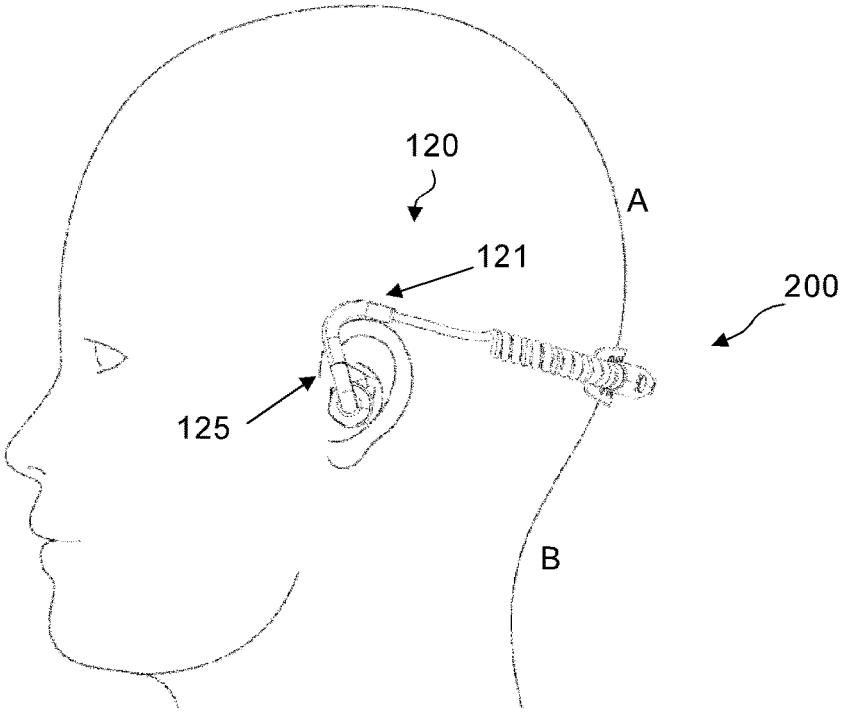
FIG. 2: A schematically side view drawing of a user wearing the headset according to the disclosure.
Figure 3:
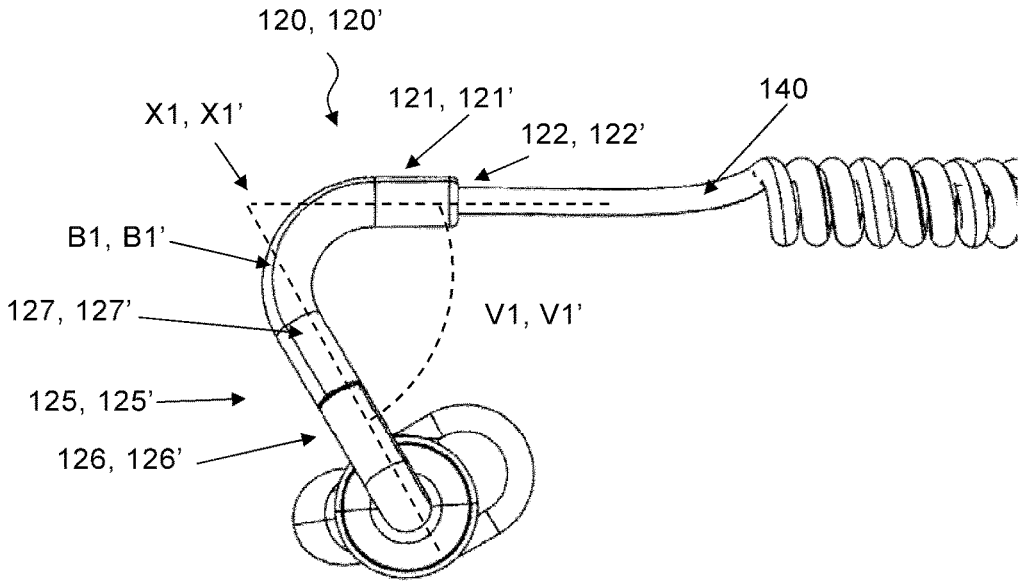
FIG. 3: A schematically side view drawing of an ear support and the transducer of the headset according to the disclosure.

Turning to FIG. 3, the ear support 120, 120' comprises an upper elongated support portion 121, 121' which extends substantially horizontally along a first elongated axis X1, X1'. The elongated support portion 121, 121' has an end 122, 122', which forms a first end 122, 122' of the ear support. The end 122, 122' is connected to a resilient cord 140 which is adapted to extend around the back of the head of a user, or adapted to extend around the neck of the user. The resilient cord 140 thereby extends between a respective end 122, 122' of the elongated support portion 121, 121'. The elongated support portion 121, 121' is adapted to be supported on the upper part of the ear of the user of the headset. By "upper part of the ear" of the user is meant the upper portion of the ear trumpet, more particularly the area where the upper portion of the ear trumpet is attached to the head of the user. FIG. 2 shows a side view of the head of a user wearing the headset according to the disclosure. In FIG. 2, the support portion 121, 121' rests on the upper part of the ear of the user. By "back of the head" or "neck" is meant approximately the region between A and B in FIG. 2.

Returning to FIG. 3, the upper elongated support portion 121, 121' is interconnected with an elongated leg 125, 125' by means of a first bend B1, B1'. The elongated leg 125, 125' thereby forms an acute angle V1, V1' with the upper elongated support portion 121, 121' For the function of the ear support 120, 120' it is preferred that the elongated leg 125, 125' forms an acute angle with the support portion 121, 121'. One reason therefore is that the elongated leg 125, 125' should extend upwards in front of the ear trumpet of the user to allow the bend B1, B1' to partially surround the upper forward portion of the ear trumpet. The upper, substantially horizontal, support portion 121, 121' may thereby rest comfortably on the upper part of the ear of the user (see FIG. 2). It is further believed that the acute angle V1, V1' between the elongated leg and the upper support portion 121, 121' of the ear support has an influence on the force by which the bend B1, B1' of the ear support is pressed against the sides of the head of the user when the headset is pulled backwards by the resilient cord.

In detail, the elongated leg 125, 125' comprises a first leg section 126, 126' extending from the end portion 130, 130' towards the first bend B1, B1' and a second leg section 127, 127' extending from the first bend B1, B1' to the first leg section 126, 126'.

The angle V1, V1' may for example be in the range of 80°-30° or 80°-40° or 80°-50° or 80°-60 or 80°-70° or 70°-30° or 70°-40° or 70°-50° or 70°-60° or 60°-30° or 60°-40° or 60°-50° or 50°-40° or 50°-30° or 40°-30°. Practical trials have shown that the bend B1, B1' of the ear support is securely pressed against the sides of the head of the user when the size of the angle V1, V1' is in the range of 50°-70°, more preferred 50°-60°, most preferred 55°-65°.

The bend B1, B1' is rounded, such that it has an arc shape. Preferably the bend B1, B1' has a radius in the range of 7-12.5 mm when the angle V1, V1' is in the range of 50°-70°. More preferred the bend B1, B1' has a radius in the range of 7-9.5 mm when the angle V1, V1' is in the range of 50°-60°, most preferred the bend B1, B1' has a radius in the range of 8.5-11 mm when the angle V1, V1' is in the range of 55°-65°. The radius of the bend B1, B1' is carefully selected. When the radius is too small, the bend B1, B1' will pinch the ear of the user which may be considered uncomfortable. When the radius is too large, the bend B1, B1' will not fit sufficiently firmly around the forward portion of the ear trumpet of the user.

Figure 4:
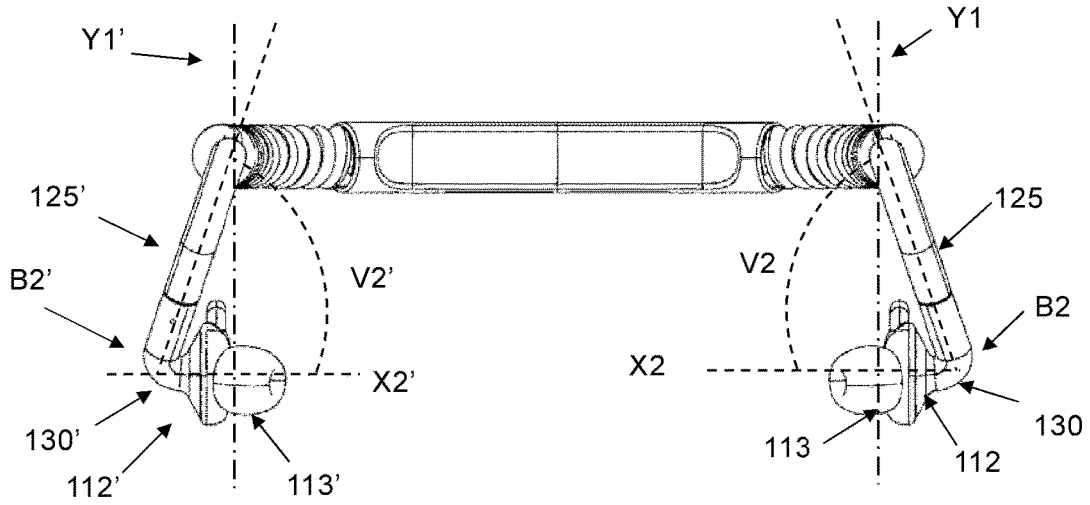
FIG. 4: A schematically front view drawing of the headset according to the disclosure.

The ear support 120' may have features analogous to features of the ear support 120 with the same numerals but with an apostrophe (') after the numeral. Turning to FIG. 4, the ear support 120, 120' comprises a second end 130, 130' by which the ear support 120, 120' is attached to the outer side 112, 112' of the audio listening device 110, 110'. The ear support 120, 120' may thereby be formed integrally, i.e. in one piece the audio listening device 110, 110'. Alternatively, the ear support 120, 120' and the audio listening device 110, 110' are discrete components that are attached to each other, for example by welding, gluing or form fitting.

The elongated leg 125, 125' of the ear support 120, 120 is attached to the outer side 112, 112' of the audio listening device such that the elongated leg 125, 125' is inclined in direction from the outer side 112, 112' of the audio listening device 110, 110' towards the inner side 111, 111' of the audio listening device 110, 110'. More specifically, the elongated leg 125, 125' of the ear support 120, 120' is inclined towards a horizontal axis Y1, Y1' which extend parallel with the inner side 111, 111' of the audio listening device 110, 110'. Since the elongated leg 125, 125' of the ear support 120, 120' is inclined towards the inner side 111, 111' of the audio listening device 110, 110' it forms an acute angle V2, V2' with a horizontal longitudinal axis X2, X2' which extends through the outer side 112, 112' and the inner side 111, 111' of the audio listening device 110, 110'.

It is important that the elongated leg 125, 125' of the ear support 120, 120' is inclined towards the inner side 113, 113' of the audio listening device 110, 110' to cause the first bend B1, B1' between the upper elongated support portion 121, 121' and the elongated leg of the ear support 120 to press against the head of a user of the headset. Moreover, the degree of inclination, which is defined by angle V2, V2' is further believed to also influence the force by which the first bend B1, B1' is pressed against the sides of the head of the user when the resilient cord pulls the headset towards the back of the head of the user. The angle V2, V2' may be in the range of 80°-50° or 80°-60 or 80°-70° or 70°-60° or 75°-65°. Practical trials have shown that the audio listening device 110, 110' is held securely in place in the ear of the user when the angle V2, V2' is in the range of 60°-80° more preferred 65°-75°. Practical trials further showed that an ear support having an inclination angle V2, V2' in the preferred range was found to rest firmly and comfortably on the head of a user.

In FIG. 4, the end portion 130, 130' of the ear support 120, 120' is interconnected with the longitudinal leg 125, 125' by a second bend B2, B2' such that the elongated leg 125, 125' and the end portion 130, 130' forms the angle V2, V2'. This is advantageously since it thereby is possible to achieve a large inclination angle V2, V2' of the ear support 120, 120' towards the head of the user.

It is also possible to attach the end 130, 130' of the elongated leg 125 directly onto the outer side 112, 112' of the audio listening device 110, 110'.

Figure 5:
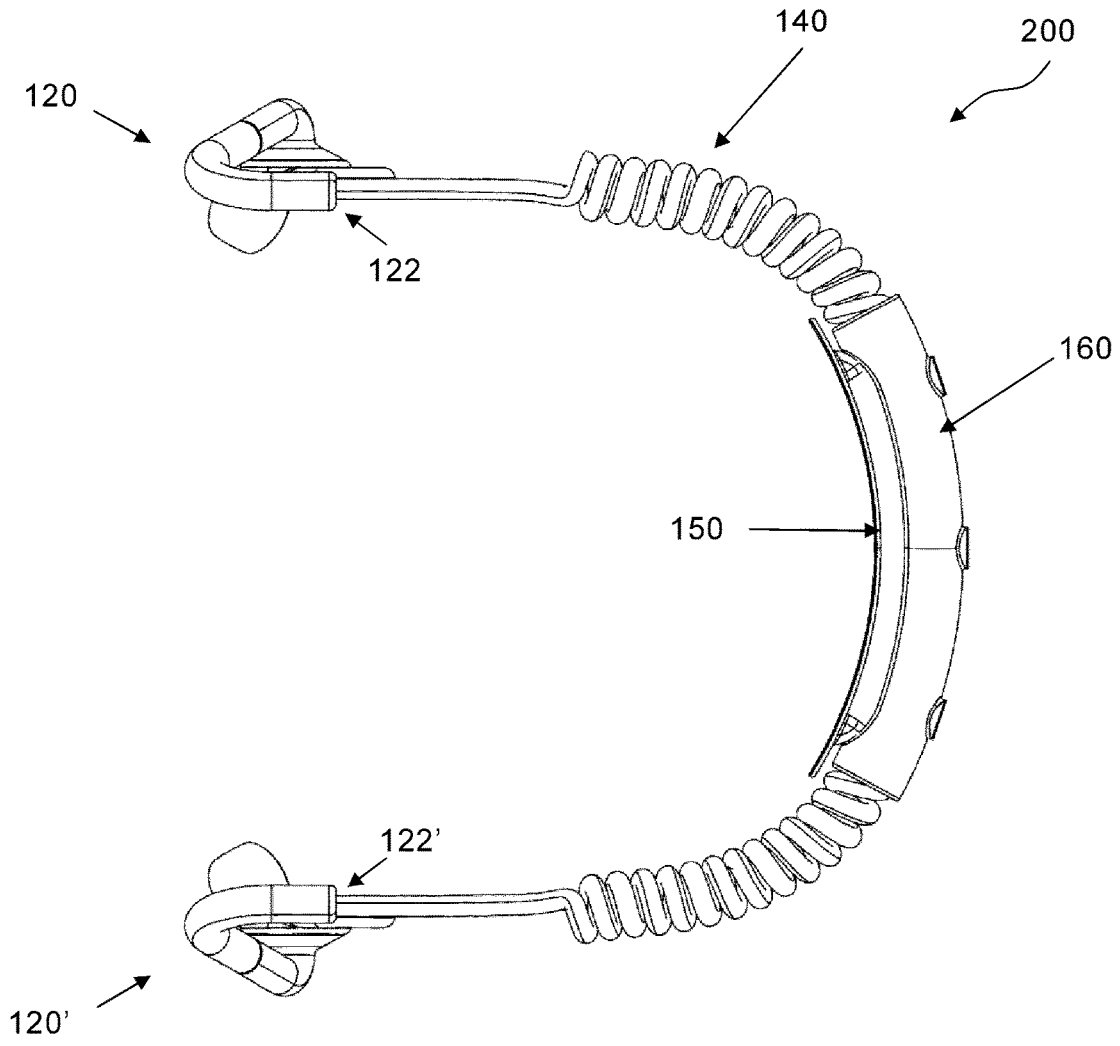
FIG. 5: A schematically top view drawing of the headset according to the disclosure.

Turning to FIG. 5, the headset 200 further comprises a resilient cord 140 which is attached to a respective first end 122, 122' of each ear support 120, 120' and adopted to extend around the rear of the head or the neck of the user of the headset. A resilient cord is preferred since the force by which the first bend B1, B1' of the ear support is pressed against the head of a user is dependent on that the upper support portion 121, 121' of the ear support 120, 120 are pulled backwards, towards the back of the head or neck of the user. The resilient cord 140 may for example be manufactured from rubber or any other suitable resilient material. It may also be formed of a material which per se lacks resilient properties but which has a shape that is resilient. Thus, the resilient cord may be, as shown in FIG. 4, a spiral cord. The resilient cord is preferably provided with electrical wires, such as copper wires, for conducting electrical signals from for example a blue-tooth unit to the transducers in the audio listening devices. For example the resilient cord is a spiral electric cable.

The headset may further comprise a device 160 for receiving wireless signals. The device may for example be a blue-tooth unit.

The device 160 may be communicatively connectable to the transducers in the audio listing device. The device 160 may thereby be integrated in one or both of the audio listening devices. The device may also be wireless communicatively connectable with the transducers in the audio listening devices.

In the described embodiment the device 160 is connected to the transducers in the audio listening devices via electrical wires in the resilient cable 140. The device 160 may thereby receive wireless signals from an electronic audio source, preferably an electronic stereo audio source such as an MP3-Player or a smart phone and conducts these signals via the electrical wires in the resilient cord. The device 160 may for example be supported on the resilient cord and connected to electrical wires in the cord. Alternatively, the device 160 may be integrated in the resilient cord 140, for example as shown in FIG. 5 in which a first cord section connects the device 160 to a first audio listening device 110 and a second cord section connects the device 160 to a second audio listening device 110'.

The headset according to the present disclosure is not limited to wireless communication between the headset and an electronic audio source. It is also possible to connect the transducers of the headset directly to the electronic audio source by electrical wires (not shown in the drawings). In this case the headset comprises an electrical wire assembly which is connected to the respective transducers and which terminates with a stereo connector, i.e. a stereo male plug for physical and electrical connection with an electronic audio source. In this case the device 160 for receiving wireless signals may optionally be omitted.

The headset may further comprise a microphone (not shown in the drawings). The microphone may be integrated in one of the ear supports of the headset and connected to the electronic device 160 which in this case is adapted to receive signals from the electronic audio source and to transmit signals to from the microphone to a receiving unit integrated in the electronic audio source, for example a smart phone. Alternatively, and analogous with the above description, the microphone may be connected by the electrical wire assembly to the receiving unit, such as a smart phone.

The head set may also comprise a neck rest 150 which is comprised in the resilient cord 140. According to an alternative the neck rest 150 and the device for receiving wireless electrical signals 160 are integrated. The casing of the device 160 may thereby be provided with a recess for receiving the neck, or the back of the head, of a user.

Returning to FIG. 3, the ear support 120 of the audio listening arrangement 100 is preferably manufactured from tube material. Tube material is light weight and has the advantage that an resilient electrical cord 140 from the device for receiving wireless signals 160 may extend through the hollow ear support 120 to a transducer in the audio listening device. When the resilient electrical cord extends through the ear support it improves the flexibility of the bend B1, B1' which in turn results in that the bend may be pressed more firmly against the head of the user. Preferably, the electrical resilient cord is thereby pre-shaped to have the same radius as the bend B1, B1'. This increases the flexibility if the bend B1, B1 even further.

The ear support 120, 120' is preferably manufactured from polymer material, for example a thermoplastic material. However, it is also possible to manufacture a portion of the ear support 120, 120' of resilient material, such as an elastomeric material or a rubber material, in order to increase the flexibility of the ear support. Preferably at least the first bend B1, B1' of the ear support 120, 120' is manufactured from, i.e. comprises resilient material, such as rubber or a TPE material such as styrenic block polymers or polyolefins or elastomeric alloys or thermoplastic polyurethanes of thermoplastic copolyester or thermoplastic polyamides.

In addition to the bend B1 B2, it is also possible to manufacture a section of the elongated leg 125, 125' in a resilient material as disclosed above. Thus, the elongated leg 125, 125' may comprise a leg section 127, 127' of resilient material, which extends from first bend B1, B2 towards the end portion 130, 130' of the elongated leg 125, 125'. By also forming a section of the elongated leg in resilient material, the degree of flexibility between the support portion 121, 121' and the elongated leg 125, 125' is increased. The first leg section 126, 126' may thereby comprise a rigid material, preferably a rigid polymer material.

Although a particular embodiment has been disclosed in detail this has been done for purpose of illustration only, and is not intended to be limiting. In particular it is contemplated that various substitutions, alterations and modifications may be made within the scope of the appended claims.

Moreover, although specific terms may be employed herein, they are used in a generic and descriptive sense only and not for purposes of limitation. Furthermore, as used herein, the terms "comprise/comprises" or "include/includes" do not exclude the presence of other elements. Finally, reference signs in the claims are provided merely as a clarifying example and should not be construed as limiting the scope of the claims in any way.

What is claimed is:

1. A headset comprising a first and a second audio listening device to be placed in a respective ear of a user, each audio listening device having an inner side and an outer side, each audio listening device further comprising an ear support for holding the audio listening device in the ear of the user, wherein each ear support is attached to opposite ends of a resilient cord adapted to extend behind the head of the user, whereby each ear support comprises:

an elongated straight support portion extending along a first longitudinal axis and configured to rest on an upper part of an ear of the user, wherein the elongated straight support portion has an end, wherein the end is connected to the resilient cord; and an elongated leg which is interconnected with the elongated straight support portion by a first bend such that the elongated leg forms an acute angle with the elongated straight support portion, whereby the elongated leg is attached to the outer side of the audio listening device such that the elongated leg is inclined in direction of the inner side of the audio listening device.

2. The headset according to claim 1, wherein the elongated leg is inclined towards a vertical axis extending in parallel with the inner side of the audio listening device.

3. The headset according to claim 1, wherein the elongated leg forms an acute angle with a second longitudinal axis extending horizontally through the inner and outer sides of the audio listening device.

4. The headset according to claim 1, wherein an end portion of the ear support is interconnected with the elongated leg by a second bend such that the elongated leg forms the acute angle with the end portion of the ear support.

5. The headset according to claim 1, wherein the elongated leg comprises an end portion, whereby the end portion is directly attached to the outer side of the audio listening device.

6. The headset according to claim 1, wherein the elongated straight support portion has an end and wherein the resilient cord extends from the end of the elongated straight support portion.

7. The headset according to claim 1, wherein the inner side of the audio listening device comprises audio conducting means for conducting acoustic signals from a transducer arranged in the audio listening device into the ear of the user.

8. The headset according to claim 1, wherein at least a portion of the inner side of the audio listening device is adapted to be placed in contact with a concha of an ear of the user.

9. The headset according to claim 1, wherein at least the first bend comprises a resilient material.

10. The headset according to claim 9, wherein the elongated leg comprises a first leg section extending from the end portion towards the first bend and a second leg section extending from the first bend to the first leg section, wherein at least the first leg section comprises a rigid material.

11. The headset according to claim 10, wherein the second leg section, the first bend and the elongated straight support portion comprise a resilient material.

12. The headset of claim 10, wherein the rigid material comprises a rigid polymer material.

13. The headset of claim 9, wherein the resilient material comprises a rubber material.

14. The headset according to claim 1, wherein the audio listening device comprises a loop shaped retainer for abutment against a concha of the ear of a user.

15. The headset according to claim 1, wherein the ear support is tubular for receiving an end of the resilient cord.

16. The headset according to claim 1, wherein the resilient cord is a spiral cable.

17. The headset according to claim 1, further comprising a device for receiving wireless electrical signals, communicatively connectable to a transducer in the audio listing devices, respectively.

18. The headset according to claim 17, wherein the resilient cord comprises electrical wires, and the device for receiving wireless electrical signals is attached to the resilient cord and connected by the electrical wires in the resilient cord, to a transducer in the audio listening devices, respectively.

19. The headset according to claim 1, further comprising a neck support which is connected to the resilient cord.

* * * * *